US007207078B1

(12) United States Patent
Lakic

(10) Patent No.: US 7,207,078 B1
(45) Date of Patent: Apr. 24, 2007

(54) BED VALANCE

(76) Inventor: Branko Lakic, 5576 Rochelle St., Las Vegas, NV (US) 89103

( * ) Notice: Subject to any disclaimer, the term of this patent is extended or adjusted under 35 U.S.C. 154(b) by 0 days.

(21) Appl. No.: 11/388,963

(22) Filed: Mar. 27, 2006

(51) Int. Cl.
*A47G 9/04* (2006.01)

(52) U.S. Cl. ..... 5/493; 5/923

(58) Field of Classification Search ..... 5/493, 5/482, 923; 297/228.11
See application file for complete search history.

(56) References Cited

U.S. PATENT DOCUMENTS 4,865,015 A * 9/1989 Hasty et al. ..... 126/500
5,715,553 A * 2/1998 Baron et al. ..... 5/493
5,733,397 A * 3/1998 McDaniel ..... 156/66
5,749,110 A * 5/1998 Gamble et al. ..... 5/493
6,598,249 B2 * 7/2003 Pajanacci et al. ..... 5/493

* cited by examiner

*Primary Examiner*—Alexander Grosz

(57) ABSTRACT

A bed valance consisting of a valance body with a center opening such that the valance body can be slipped over a mattress top onto a box spring without the need for removing the mattress when replacement or changing of the bed valance is necessary. The valance is removably attachable to a box spring with hook and loop fasteners sewn to the top of the box spring, and includes a tightening cord at its inner periphery.

5 Claims, 5 Drawing Sheets

BED VALANCE

FIELD OF THE INVENTION

The present invention generally relates to a bedding apparatus and more particularly, relates to bed valance that can be used to cover a box spring without removing a mattress placed on top.

BACKGROUND OF THE INVENTION

Bed valance, or bed skirt has been used as a popular bedding apparatus for many years. Bed valance is normally used to fit around a bed, over a box spring, to hide the space underneath a bed, or the space between the box spring and the floor surface. The bed valance can be supplied in a variety of designs, fabrics, and colors.

Conventionally, the bed valance is formed in a single piece construction complete with a center panel. When the bed valance needs to be changed for washing, the mattress on top of the box spring must first be removed in order to access or remove the bed valance from the box spring. This is a tedious task that must be handled by more than one person. It would be desirable to provide a bed valance that fits over a box spring, but does not require the removal of the mattress when the bed valance has to be removed for cleaning.

It is therefore an object of the present invention to provide a bed valance that does not have the drawbacks or shortcomings of the conventional bed valances.

It is another object of the present invention to provide a bed valance that is equipped with a center opening.

It is a further object of the present invention to provide a bed valance that is equipped with a center opening of sufficient size such that the valance can be slipped over a mattress.

It is still another object of the present invention to provide a bed valance that is equipped with a plurality of hook-and-loop fasteners for fastening to a box spring.

SUMMARY OF THE INVENTION

In accordance with the present invention, a bed valance that is equipped with a center opening for fitting over a box spring is provided.

In a preferred embodiment, a bed valance is provided which has a valance body with a center opening, an inner periphery surrounding the center opening, a top surface and a bottom surface; the center opening has a size sufficiently large for a mattress to slip therethrough when the mattress is placed in a horizontal position; and a plurality of hook-and-loop fasteners on the bottom surface of the valance body surrounding and juxtapose to the center opening.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a bed valance that is constructed of a valance body which has a center opening for slipping over a mattress, and a plurality of hook-and-loop fasteners on a bottom surface of the valance for fastening to the box spring.

The present invention improved bed valance allows a person to easily replace bedding without lifting the mattress. The bed valance is equipped with easy to attach hook-and-loop fasteners. The detachable bed valance includes a series of hook-and-loop fasteners, or Velcro fasteners, each measuring 1½ inch long and 2 inches wide, such that the valance can be easily secured along the sides of a box spring. Corresponding Velcro pieces would be sewn into the top of the box spring. The present invention improved bed valance is designed to fit around a bed for an attractive look and to effectively hide the space underneath a bed.

The present invention bed valance can be easily detached, or removed for cleaning or replacement. It can be produced in a variety of sizes to accommodate twin, full, queen and king sized beds. The colors and designs of the bed skirt varies depending on the bedroom decor. The bed valance can be produced in a similar version that can be applied to the mattress protection and to keep it from sliding off the mattress.

The present invention bed valance fulfills the need for a modified bed valance, or bed skirt that eliminates lifting the mattress for replacement or cleaning. The bed valance has the appealing features of convenience, ease of use, practicality, and attractiveness. It can be easily attached to a bed cover for an attractive decoration. It eliminates the necessity of lifting the mattress to remove the valance for cleaning or replacement. With a conventional bed valance, a mattress must be lifted in order to place the valance on top of the box spring. Such a task would usually require two people and thus is highly inconvenient for those who live by him or herself. With the present invention bed valance, a Velcro type fastener is used to easily attach the valance to the box spring without removing the mattress from the bed. Based on such convenient design, the bed valance would not have to be adjusted while bed sheets are being tucked underneath the mattress. The bed valance is easy to use, simple to clean, convenient and attractive.

The present invention bed valance is ideal for the busy homemaker who does not have the time to remove a heavy mattress for the simple task of cleaning or replacing a bed valance. In addition, the bed valance can be used commercially in hotels, motels which would benefit from the ease and convenience of attaching a bed valance.

Figure 1:
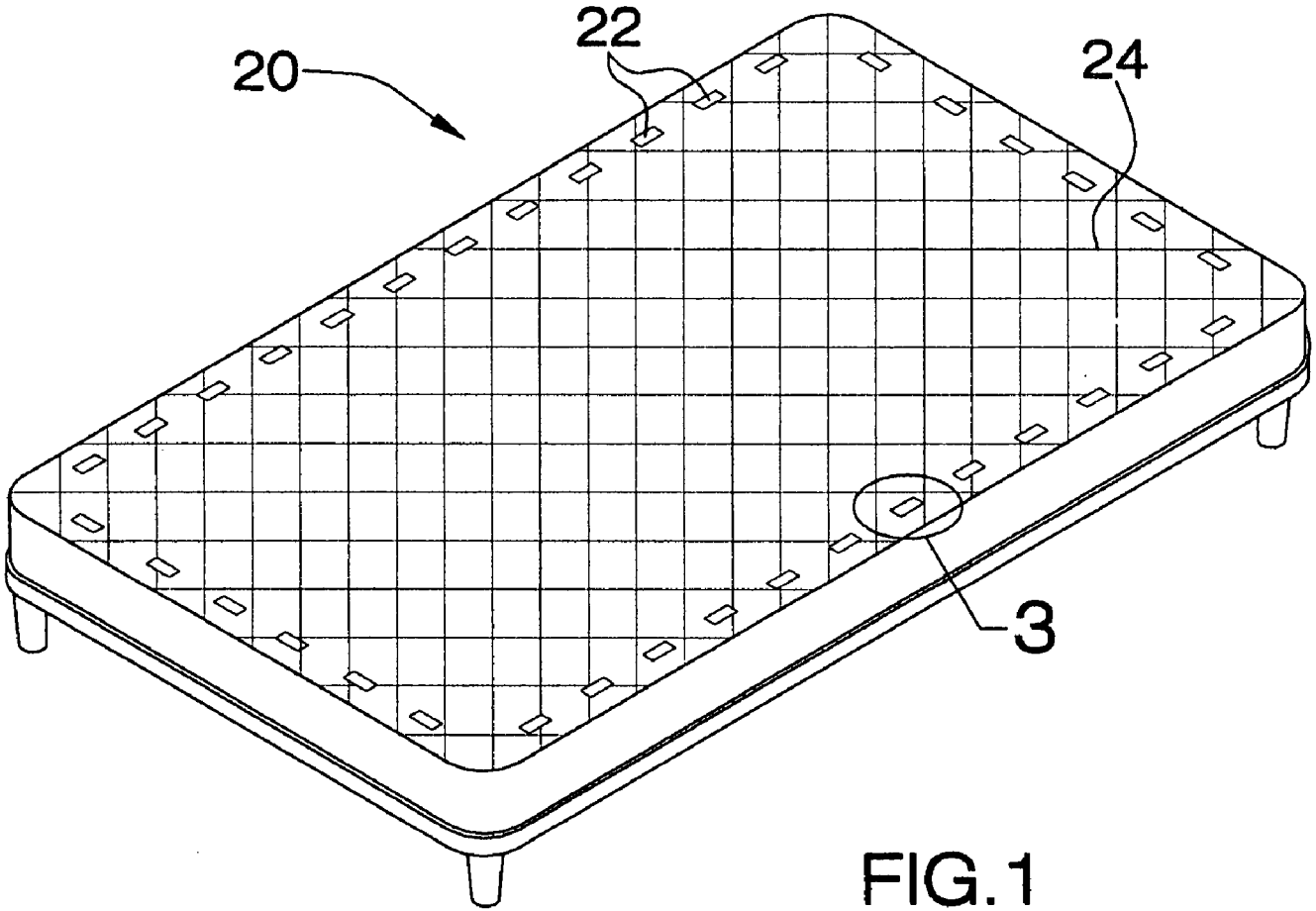
FIG. 1 is a perspective view of a box spring for the present invention bed valance.
Figure 2:
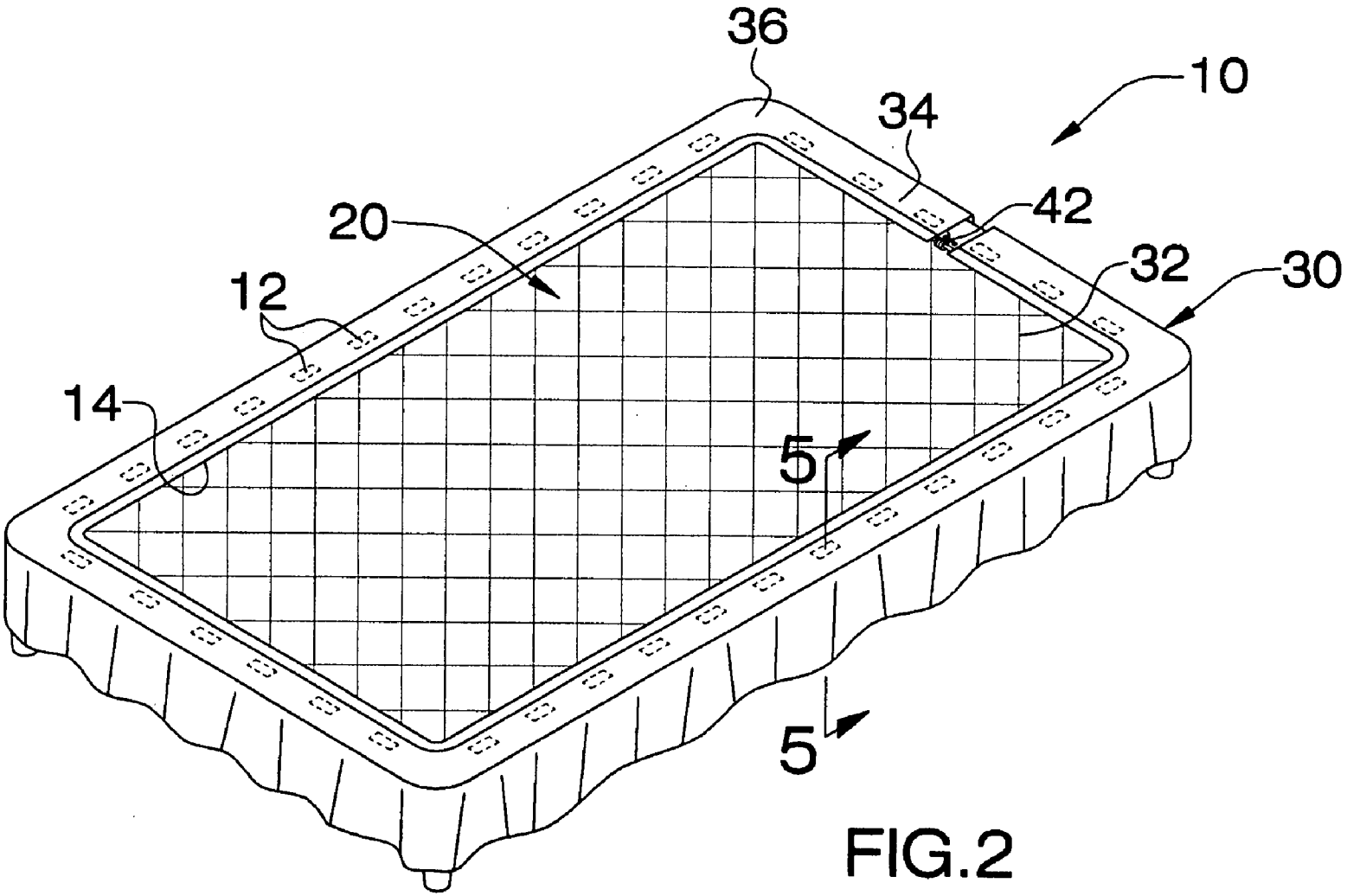
FIG. 2 is a perspective view of the present invention bed valance fastened to the box spring of FIG. 1.

Referring initially to FIG. 1, wherein a box spring 20 equipped with a plurality of hook-and-loop fasteners 22 is shown. The hook-and-loop fasteners 22 may be advantageously sewn into the top surface 24 of the box spring 20, or can be glued to the top surface 24. The present invention bed valance 10, shown in FIG. 2, is then mounted or positioned on the box spring 20 by attaching the hook-and-loop fasteners 12 that is sewn on the bottom side 14 of the bed valance 10.

The present invention bed valance 10 is constructed of a valance body 30 which has a center opening 32, an inner periphery 34 surrounding the opening 32, a top surface 36 and a bottom surface 14. The center opening 32 has a size sufficiently large for a mattress (not shown) to slip therethrough when the mattress is placed in a horizontal position. The valance body 30 is further equipped with a plurality of hook-and-loop fasteners 12 on the bottom surface 14 of the valance body 30 surrounding and juxtaposed to the center opening 32.

Figure 3:
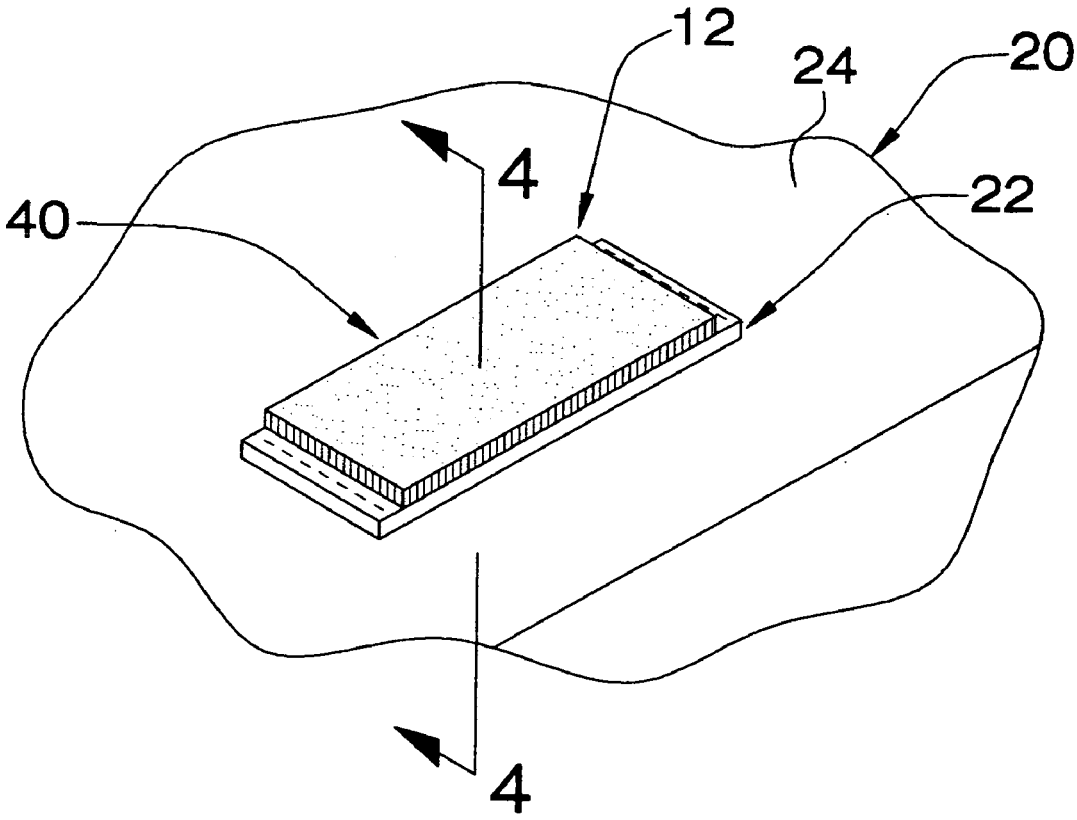
FIG. 3 is a partial, sectional view of the hook-and-loop fastener used on the present invention bed valance.

FIG. 3 is a perspective view of the hook-and-loop fastener 40, which consists of a loop portion 22 and a hook portion 12. The loop portion 22 is sewn onto the top surface 24 of the box spring 20.

Figure 4:
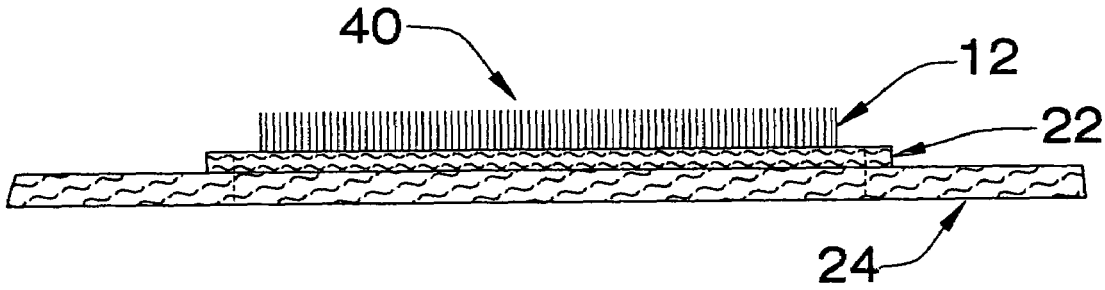
FIG. 4 is a cross-sectional view of the hook-and-loop fastener shown in FIG. 3.

A cross-sectional view of the hook-and-loop fastener 40 of FIG. 3 is shown in FIG. 4 illustrating the hook portion 12, the loop portion 22, and the top surface 24 of the box spring.

Figure 5:
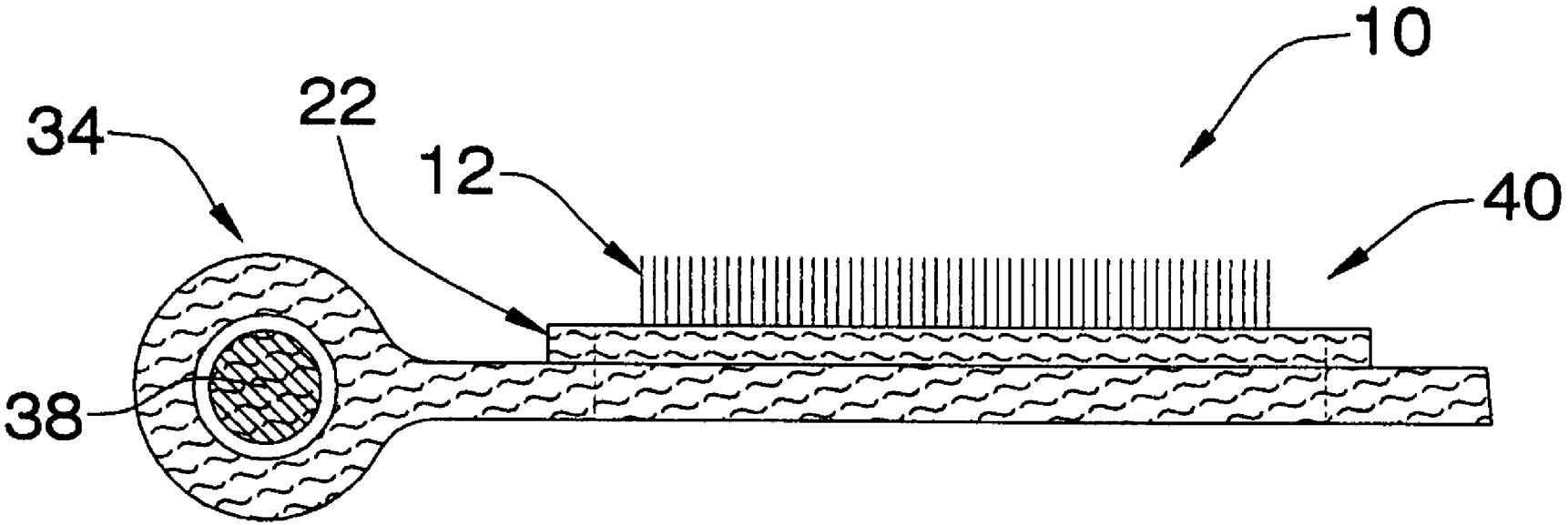
FIG. 5 is a cross-sectional view of the hook-and-loop fastener mounted on the inner periphery of the center opening of the bed valance.

Another cross-sectional view is shown in FIG. 5 which not only includes the hook-and-loop fastener 40, but also includes the inner periphery 34 of the present invention bed valance 10. The inner periphery 34 further includes a cord 38 which may be tightened at a valance body opening 42 (shown in FIG. 2) after the bed valance 10 is fitted over the box spring 20. The cord 38 may be advantageously made of nylon, or may be of an elastic cord that would tighten the inner periphery 34 to provide an improved fit over the box spring 20.

The present invention bed valance has therefore been amply described in the above description and in the appended drawings of FIGS. 1–5.

While the preferred embodiments of the invention have been described above, it will be recognized and understood that various modifications can be made in the invention and the appended claims are intended to cover all such modifications which may fall within the spirit and scope of the invention.

What is claimed is:

1. In combination with a box spring having a plurality of spaced apart hook and loop fasteners sewn into the top thereof, a bed valance comprising:

a valance body adapted to substantially surround the periphery of said box spring, while leaving a valance body opening, said valance body having a center opening, an inner periphery surrounding said center opening, a top surface and a bottom surface;

said center opening having a size sufficiently large for a mattress to slip therethrough when said mattress is placed in a horizontal position;

a plurality of spaced apart hook-and-loop fasteners sewn on said bottom surface of the valance body surrounding and juxtaposed to said center opening and a cord in said inner periphery of the valance body for tightening said center opening after mounting of the valance to the box spring, said cord accessible through the valance body opening.

2. The bed valance according to claim 1, wherein said cord is an elastic cord.

3. The bed valance according to claim 1, wherein said bed valance is fabricated of a fabric.

4. The bed valance according to claim 1, wherein said valance body covers an edge portion of at least two inches of a box spring.

5. The bed valance according to claim 1, wherein said valance body covers an edge portion of at least four inches on said box spring.

* * * * *